US006452333B1

(12) United States Patent
Torisaki et al.

(10) Patent No.: US 6,452,333 B1
(45) Date of Patent: Sep. 17, 2002

(54) PLASMA DISPLAY PANEL

(75) Inventors: Yasuhiro Torisaki; Mitsunori Taguchi, both of Yamanashi (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/473,996

(22) Filed: Dec. 29, 1999

(30) Foreign Application Priority Data

Feb. 19, 1999 (JP) ..... 11-042365

(51) Int. Cl.[7] ..... H01J 17/49

(52) U.S. Cl. ..... 313/586; 313/584; 345/60; 345/72; 345/152

(58) Field of Search ..... 345/60, 72, 152; 313/584, 586

(56) References Cited

U.S. PATENT DOCUMENTS 5,587,624 A * 12/1996 Komaki ..... 313/584
5,966,107 A * 10/1999 Amemiya ..... 345/60
6,088,011 A * 7/2000 Lee et al. ..... 345/60

* cited by examiner

*Primary Examiner*—Sandra O'Shea
*Assistant Examiner*—Guiyoung Lee
(74) *Attorney, Agent, or Firm*—Sughrue Mion, PLLC

(57) ABSTRACT

A plasma display panel, in which the area of a pair of transparent electrodes forming a pair of row electrodes within at least a discharge cell for one color display out of discharge cells for respective color display as partitioned cells by means of bus electrodes and barriers is made different from the area of the pairs of transparent electrodes within discharge cells for other color display.

13 Claims, 7 Drawing Sheets

FIG. 1A

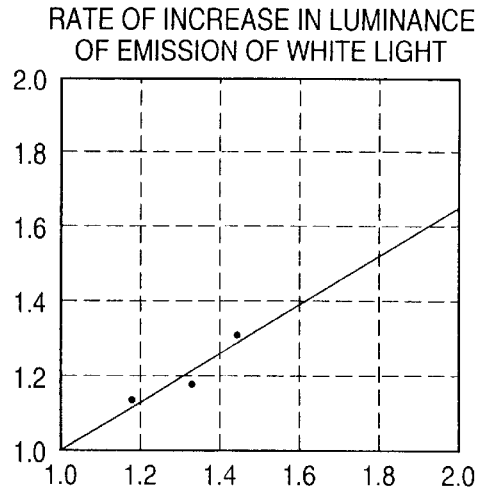

VARIATION IN RATE OF INCREASE IN LUMINANCE OF EMISSION OF LIGHT DUE TO INCREASE OF ELECTRODE AREA

WHEN ELECTRODE AREA IS INCREASED AT THE SAME RATE IN ALL RGB, 1 IS SET WHEN THE INCREASE OF THE AREA IS 0

FIG. 1B

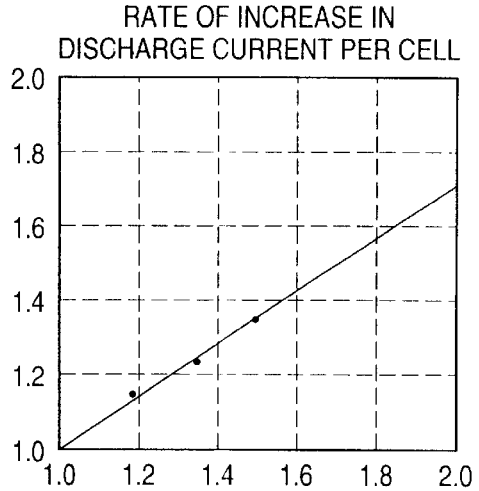

VARIATION IN RATE OF INCREASE IN LUMINANCE OF EMISSION OF LIGHT DUE TO INCREASE OF ELECTRODE AREA

WHEN ELECTRODE AREA IS INCREASED AT THE SAME RATE IN ALL RGB, 1 IS SET WHEN THE INCREASE OF THE AREA IS 0

FIG. 2A

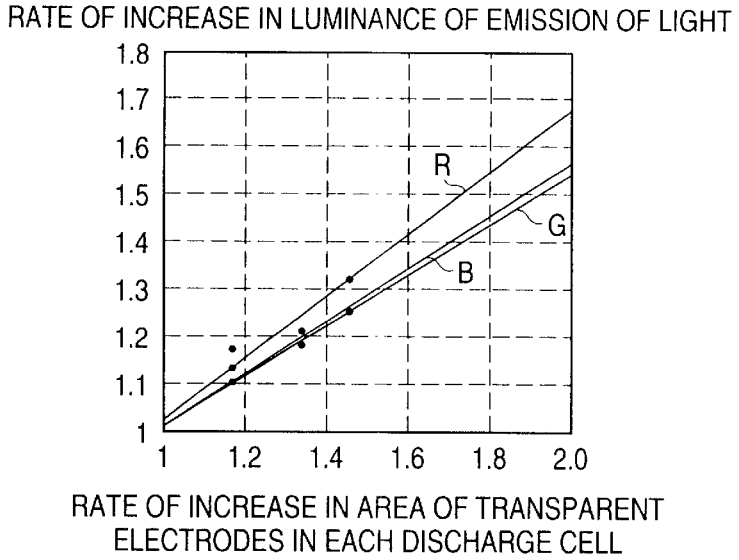

VARIATION IN RATE OF INCREASE IN LUMINANCE DUE TO INCREASE OF ELECTRODE AREA IN EACH FLUORESCENT MATERIAL

WHEN ELECTRODE AREA IS INCREASED AT THE SAME RATE IN ALL RGB, 1 IS SET WHEN THE INCREASE OF THE AREA IS 0

FIG. 2B

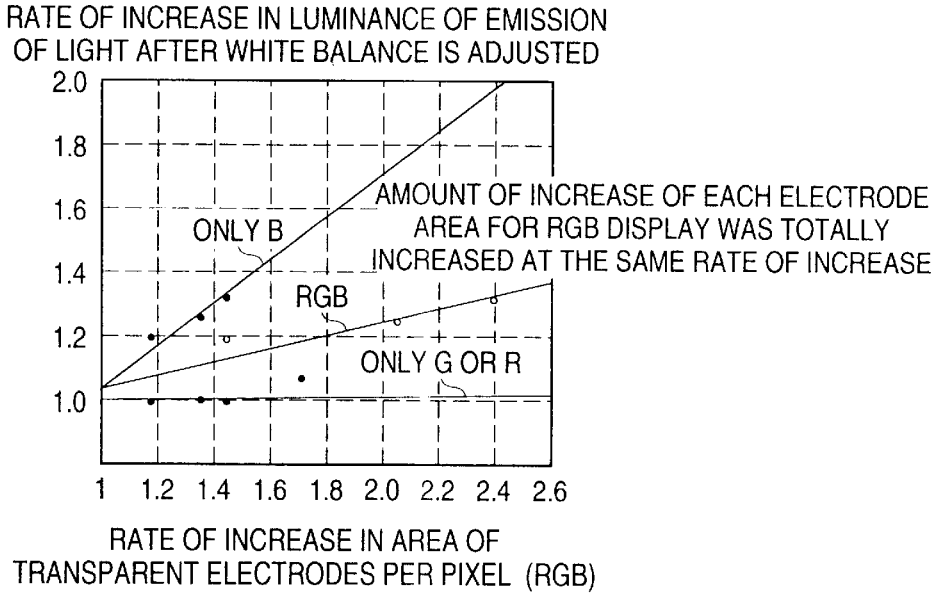

VARIATION IN RATE OF INCREASE IN LUMINANCE AFTER WB ADJUSTMENT DUE TO INCREASE OF ELECTRODE AREA

WHEN ELECTRODE AREA IS INCREASED AT THE SAME RATE IN ALL RGB, 1 IS SET WHEN THE INCREASE OF THE AREA IS 0

$S_B > S_G > S_R$ $S_B > S_R > S_G$ $S_B > S_G > S_R$ $S_B > S_R > S_G$ $S_B > S_G > S_R$ $S_B > S_R > S_G$

PLASMA DISPLAY PANEL

BACKGROUND OF THE INVENTION

1. Field of the Invention

This invention relates to a plasma display panel (hereinafter referred to as PDP) for color display, which is a flat display of a self-emission of light type utilizing a gas discharge.

2. Description of the Related Art

Plasma display panels (PDPs) are generally so configured that electrodes in pairs are regularly arranged in two opposing glass substrates with gases mainly containing Ne, Xe and the like enclosed therebetween. A discharge of electricity is then caused in minute cells around the electrodes by applying voltage across the electrodes to make each cell give off light emissions for displaying purposes. In order to have information displayed, the cells regularly disposed are selectively made to give off light emissions. The PDPs are classified into two types: namely, a DC type in which electrodes are exposed to a discharge space; and an AC type in which electrodes are covered with insulating layers.

FIG. 7 shows an example of the structure of an AC type PDP 50 in such a state that the front plate has been set apart from the back plate. As shown in FIG. 7, two sheets of glass substrates 1 and 6 are disposed in parallel and opposite to each other, and both of them are maintained by barriers 7 with a predetermined space held therebetween, the barriers 7 being provided in parallel to each other on the backside glass substrate 6.

On the back side of the glass substrate 1 as the front side of the PDP 50 are parallel row electrodes X and Y, the row electrodes X and Y comprising transparent electrodes 2 and metallic electrodes as bus electrodes 3, respectively. There are also formed a dielectric layer 4 covering the row electrodes, and a protective layer 5 (MgO layer) formed on the dielectric layer 4. Further, each of parallel column electrodes 8 is formed between the barriers 7 on the front side of the glass substrate 6 as the back side so that the column electrodes 8 may intersect the row electrodes X and Y at right angles. Fluorescent materials 9 are provided in such a way as to cover the wall surfaces of the barriers 7 and the base s of cells, respectively. Moreover, the glass substrates 1 and 6 are disposed opposite to each other and a discharge gas containing a mixture of neon, xenon and the like is injected into and enclosed within a discharge space 10 between the barriers 7.

This AC type PDP 50 is of a superficial discharge type and so structured that an AC voltage is applied across the row electrodes X and Y on the glass substrate 1 to make a discharge with an electric field leaked in a space. In this case, the direction of the electric field varies with the frequency because the AC voltage is applied. The fluorescent materials 9 are caused to emit light by the ultraviolet rays of light generated by the discharge, and the light transmitted through the glass substrate 1 as a display side is visually recognized by an observer.

Such a PDP 50 is manufactured by forming the column electrodes 8 on the backside glass substrate 6, the dielectric layer 4 in such a way as to cover the column electrodes 8 as occasion demands and the barriers 7 and then providing each of the fluorescent material layers 9 between the barriers 7. There are known methods of forming the column electrodes 8 including a method comprising the steps of forming films of an electrode material on the backside glass substrate 6 by vacuum evaporation, sputtering, plating, thick film processing and the like and then subjecting the films thus formed to lithography for patterning purposes, and a screen printing method for patterning using a thick film paste. The dielectric layer 4 is formed by the screen printing method or the like. Further, the barriers 7 are formed by double printing through the screen printing, a sandblasting or the like. The fluorescent material layer 9 is formed by the screen printing or the like in which fluorescent paste of three colors of red (R), green (G) and blue (B) is selectively filled in between the barriers 7 or by lithography using photosensitive fluorescent paste.

Incidentally, the luminance of the fluorescent materials of the three colors for use in making color display are different and therefore, the chromaticity of white light (white balance) is normally adjusted by adjusting the level of an input signal for each color. When the levels of input signals for green and red colors are reduced relative to the level of an input signal for blue color, for example, a discharge cell for blue color display is such that up to 256 gradations of the maximum luminance can be displayed but in the case of discharge cells for green and red color display, the luminance of emission of light up to gradations lower than those of the maximum luminance is only obtainable. Therefore, the display gradations in the luminescence display of the discharge cells differ with the color and the problem is that the gradation display quality becomes greatly deteriorated.

SUMMARY OF THE INVENTION

An object of the present invention intended to solve the foregoing problem is to provide a plasma display panel capable of properly adjusting the chromaticity of white light without lowering the gradation level of each color.

In order to achieve the above object, according to the present invention, there is provided a plasma display panel comprising: a pair of substrates disposed opposite to each other through a discharge space; a plurality of pairs of row electrodes disposed on an inner surface of one of the pair of substrates; a dielectric layer for covering the pairs of row electrodes from the discharge space; a plurality of column electrodes extended in a direction of intersecting the pairs of row electrodes on an inner surface of the other of the pair of substrates in order to form a discharge cell in each intersecting portion; and fluorescent material layers for covering the column electrodes and giving off blue, green and red color light emissions, wherein an area of the pair of row electrodes within at least a discharge cell for one color display out of the discharge cells for the color display is made different from areas of the pairs of row electrodes within the discharge cells for other color display.

BRIEF DESCRIPTION OF THE DRAWINGS

FIG. 1A is a graphic representation showing the relation between the area of transparent electrodes forming a PDP and the luminance of emission of white light.

FIG. 1B is a graphic representation showing the relation between the area of the transparent electrodes and the discharge current per cell.

FIG. 2A is a graphic representation showing the relation between the area of each of the transparent electrodes forming the PDP and the luminance of emission of light.

FIG. 2B is a graphic representation showing the relation between the area of each of the transparent electrodes and the luminance of emission of light after white balance is adjusted.

DETAILED DESCRIPTION OF THE PREFERRED EMBODIMENTS

Figure 3A:
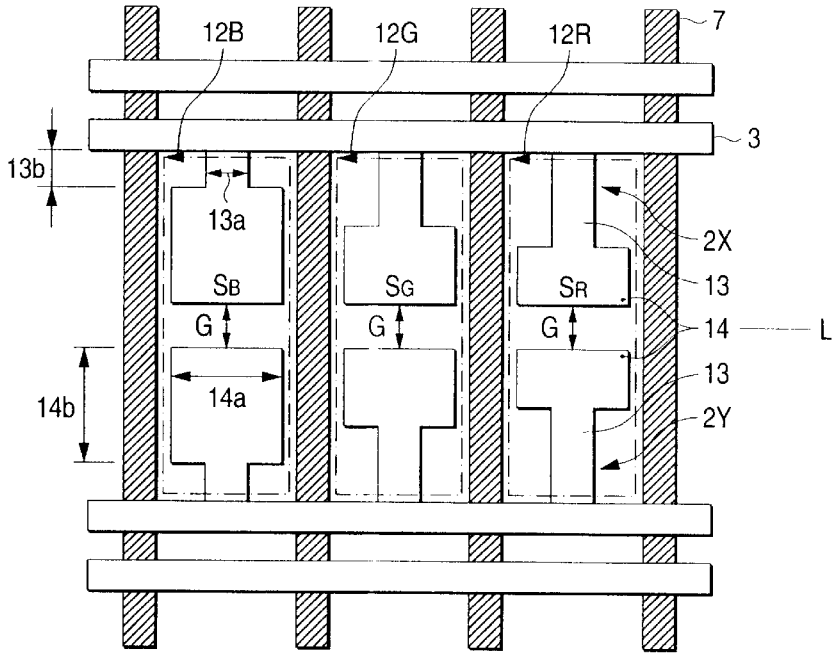
FIGS. 3A and 3B are structural diagrams of transparent electrodes of a PDP according to a first embodiment of the invention.

A PDP according to the present invention is designed to adjust the chromaticity (white balance) of emission of white light by making different the area of transparent electrodes forming row electrodes in each discharge cell for each color display. The relation of the area of the transparent electrode to the luminance of emission of light will now be described prior to describing the structure of the transparent electrode according to an embodiment of the PDP according to the present invention.

FIG. 1A is a graphic representation showing the relation between the area of the transparent electrodes forming the PDP and the luminance of emission of white light, and specifically showing a rate of increase in the luminance of emission of white light on the vertical axis and a rate of increase in the area of the transparent electrodes per pixel (RGB) on the horizontal axis; that is, there is shown therein a rate of increase in the area of the transparent electrodes when the area of thereof within the three discharge cells for R, G and B display is increased at the same rate and when 1 is set in a case where the area thereof is not increased. As will be understood from the graph, the luminance of emission of white light is seen to increase in proportion to the area of the transparent electrodes as the area thereof increases. FIG. 1B shows a rate of increase in the discharge current per discharge cell on the vertical axis and a rate of increase in the area of the transparent electrodes per pixel (RGB) as in FIG. 1A on the horizontal axis. As is obvious from the graph, the discharge current increases as the area of the transparent electrodes increases.

FIG. 2A is a graphic representation showing the relation between a rate of increase in the area of the transparent electrodes in the discharge cell for each color (RGB) display and a rate of increase in the luminance of emission of light. A rate of increase in the luminance of emission of light of the PDP is shown on the vertical axis and a rate of increase in the area of the transparent electrodes per discharge cell is shown on the horizontal axis; that is, there are shown therein a variation in the luminance of emission of light due to the increase of the area of the electrodes per fluorescent material and a rate of increase in the area thereof when 1 is set in a case where the area thereof is not increased. As will be understood from the graph, the luminance of emission of light is seen to increase when the area of the transparent electrodes of each color increases. Further, FIG. 2B shows a rate of increase in the luminance of emission of light after the adjustment of the white balance relative to the increase of the area of the transparent electrodes per pixel (RGB). As will be understood from the graph, a rate of increase in the luminance of emission of light after the adjustment of the white balance relative to the increase of the area of the transparent electrodes is seen to be greater in the case where only the area of the transparent electrodes for blue color (B) display is increased than the case where the area of the transparent electrodes is totally and equally increased relative to one pixel (RGB).

From the relation shown by each of the graphs above, it will be understood that the chromaticity of emission of white light, that is, the white balance can be adjusted by making the area of the transparent electrodes of the discharge cell for blue color display relatively greater than that of the transparent electrodes of the discharge cell for green or red color display and varying the relative luminance of emission of light.

Moreover, it will also be understood that the increase of the discharge current is restrained and the luminance after the adjustment of the white balance is increased further than the case where the area of the transparent electrodes is totally and equally increased relative to one pixel (RGB) by relatively increasing the area of the transparent electrodes of the discharge cell for blue color display and varying the relative luminance of emission of light.

From the description above, the PDP according to the this embodiment is formed by making different the area of the transparent electrodes forming row electrodes in each discharge cell for each color display in proportion to the luminance of emission of light of each fluorescent material in order to adjust the chromaticity (white balance) of the emission of white light.

Figure 3B:
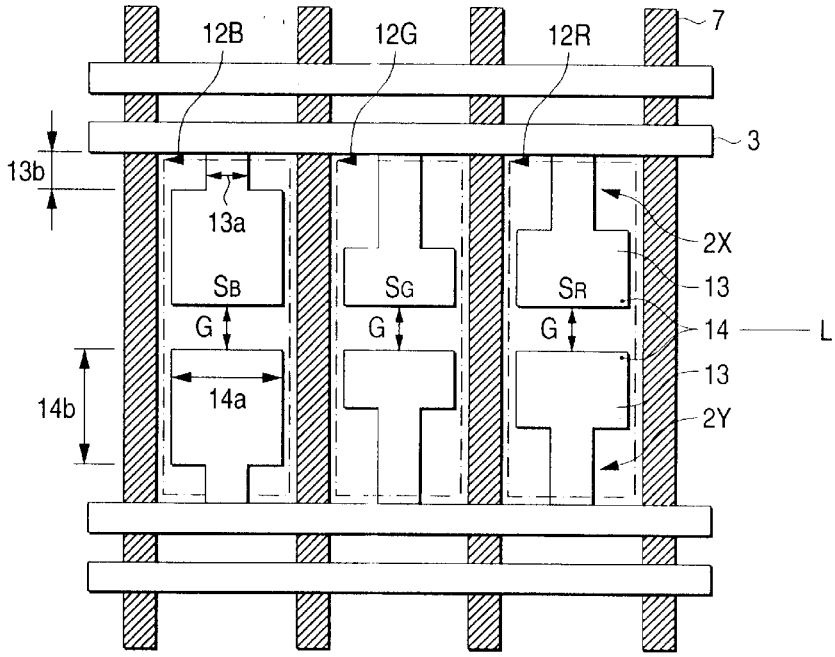

FIGS. 3A and 3B are partially enlarged views of a PDP 50 according to a first embodiment of the invention. FIGS. 3A and 3B show only partitioned discharge cells 12R, 12G and 12B for three color display in which pairs of transparent electrodes 2X and 2Y forming pairs of opposing row electrodes X and Y are enclosed by bus electrodes 3 and barriers 7, respectively.

Each of the pairs of row electrodes X and Y essentially consists of a pair of T-shaped independent transparent electrodes 2X and 2Y for the discharge cell 12 of each color and the bus electrodes 3. The pair of transparent electrodes 2X and 2Y have narrow portions 13 on the respective side of the bus electrodes 3 and wide portions 14 at their respective leading ends. The wide portions 14 are set close and made to face each other so as to form a discharge gap G. In this case, the opposite-to-discharge-gap end portions of the pair of transparent electrodes 2X and 2Y and the respective bus electrodes 3 are overlapped and electrically connected.

In cases where the width (length in the direction of a line L as shown by a double headed arrow) of the narrow portion 13 is indicated by reference numeral 13*a,* where the length (length in a direction perpendicular to the line L) thereof by 13*b,* where the width of the wide portion 14 is indicated by 14*a* and where the length thereof by 14*b,* the area of each transparent electrode 2 within the discharge cell 12 is indicated by the sum total of the area (13*a*×13*b*) of the narrow portion 13 and the area (14*a*×14*b*) of the wide portion 14.

The area of each transparent electrode 2 can be made variable by, for example, increasing the length 14*b* of the wide portion 14 together with decreasing the length 13*b* of the narrow portion 13 and keeping the discharge gap G having a fixed width while setting the width 13*a* of the narrow portion 13 and the width 14*a* of the wide portion 14 fixedly.

Given that the area of the transparent electrode 2 within the discharge cell 12B for blue color display is indicated by $S_B$, that the area of the transparent electrode 2 within the discharge cell 12G for green color display is indicated by $S_G$ and that the area of the transparent electrode 2 within the discharge cell 12R for red color display is indicated by $S_R$, the PDP 50 shown in FIG. 3A is formed so that the area of each of the transparent electrodes 2 may satisfies the following expression by varying the length 14*b* of the wide portion 14 of the transparent electrode 2 on a discharge cell 12 basis.

$$S_B > S_G > S_R \quad (1)$$

The discharge cells 12 formed with the respective transparent electrodes 2 according to Expression (1) are such that the light emitted by the discharge cell 12G for green color display is brighter than what is emitted by the discharge cell 12R for red color display and that the light emitted by the discharge cell 12B for blew color display is brighter than what is emitted by the discharge cell 12G for green color display.

The PDP 50 shown in FIG. 3B is formed so that the area of each of the transparent electrodes 2 may satisfies the following expression through the same process as shown above.

$$S_B > S_R > S_G \quad (2)$$

The discharge cells 12 formed with the respective transparent electrodes 2 according to Expression (2) are such that the light emitted by the discharge cell 12R for red color display is brighter than what is emitted by the discharge cell 12G for green color display and that the light emitted by the discharge cell 12B for blew color display is brighter than what is emitted by the discharge cell 12R for red color display.

In other words, the area $S_B$ of the transparent electrode 2 for blew color display having the weakest luminance of emission of light is made largest and by subsequently forming the areas of the other transparent electrodes 2 in proportion to the luminance of emission of light of the respective fluorescent materials, the chromaticity of the white emission light of the PDP 50 is adjusted.

Figure 4A:
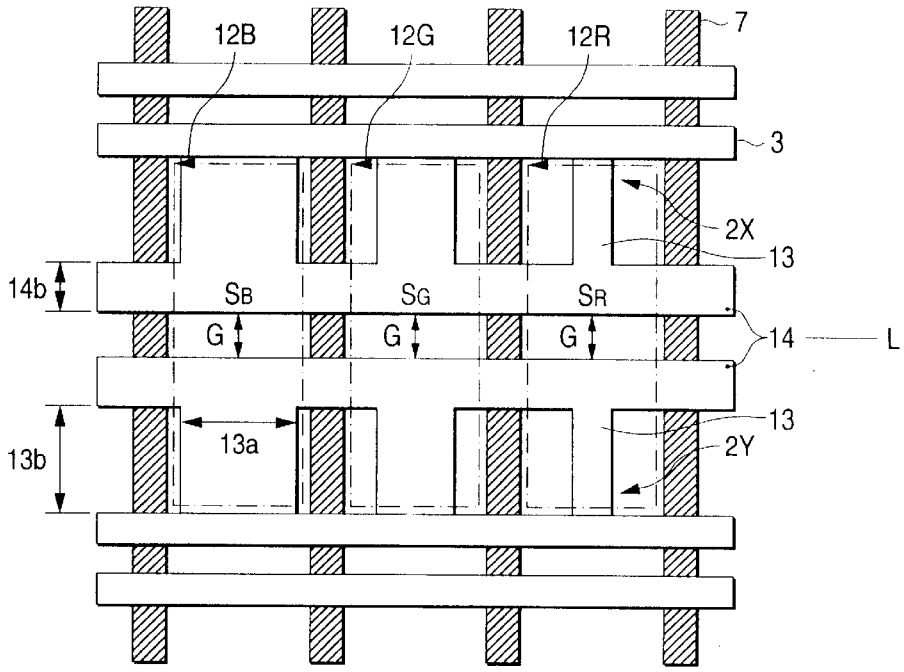
FIGS. 4A and 4B are structural diagrams of transparent electrodes of a PDP according to a second embodiment of the invention.
Figure 4B:
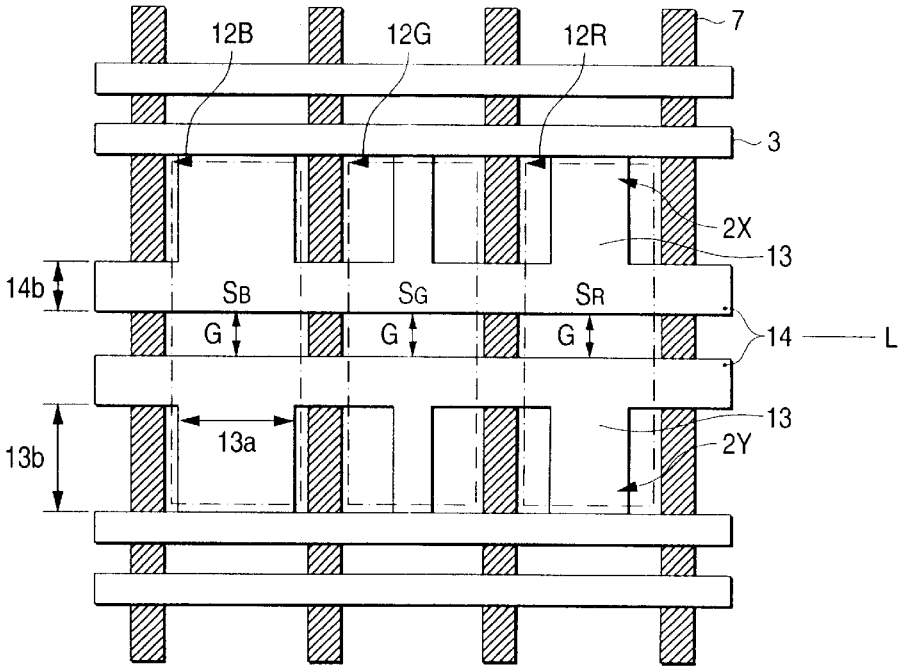

FIGS. 4A and 4B show a PDP 50 according to a second embodiment of the invention, illustrating a modified example of pairs of transparent electrodes 2X and 2Y in the first embodiment thereof.

In the PDP 50 shown in FIGS. 4A and 4B, the wide portions 14 of the respective transparent electrodes 2 having a fixed length 14*b* are continuously formed in the direction of the line L while the discharge gap G is kept having a fixed width (the wide portions 14 being continuously formed with adjoining cells in the direction of the line L) and the area of each transparent electrode 2 is made different by varying the width 13*a* of the narrow portion 13.

The PDP 50 shown in FIG. 4A is formed like what is shown in FIG. 3A in the first embodiment of the invention so as to make the area of the transparent electrode 2 within each discharge cell 12 satisfy Expression (1). Further, the PDP 50 shown in FIG. 4B is similarly formed so as to make the area of the transparent electrode 2 within each discharge cell 12 satisfy Expression (2). Therefore, the chromaticity of the emission of white light of the PDP 50 is adjusted as in the first embodiment of the invention.

Figure 5A:
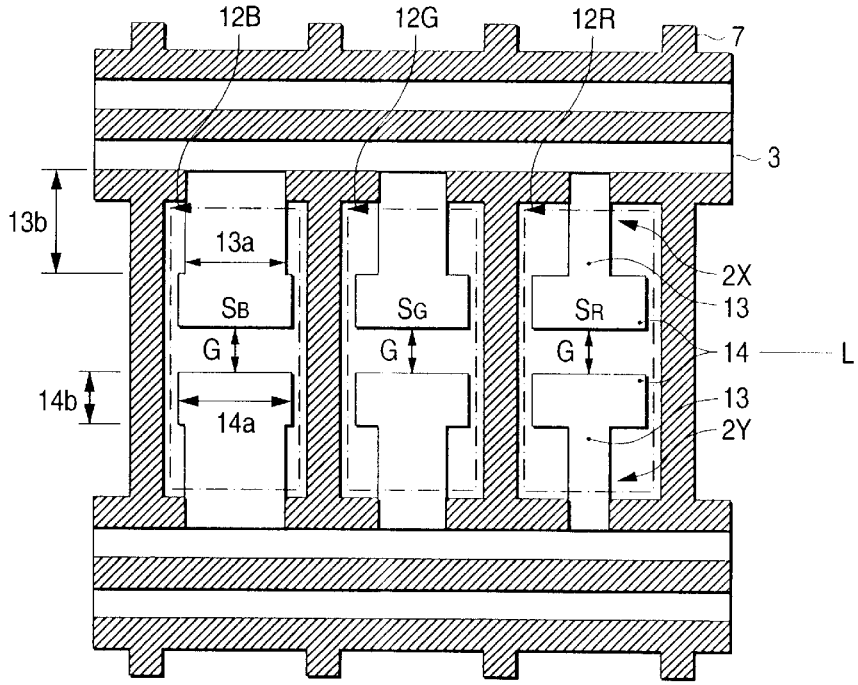
FIGS. 5A and 5B are structural diagrams of transparent electrodes of a PDP according to a third embodiment of the invention.
Figure 5B:
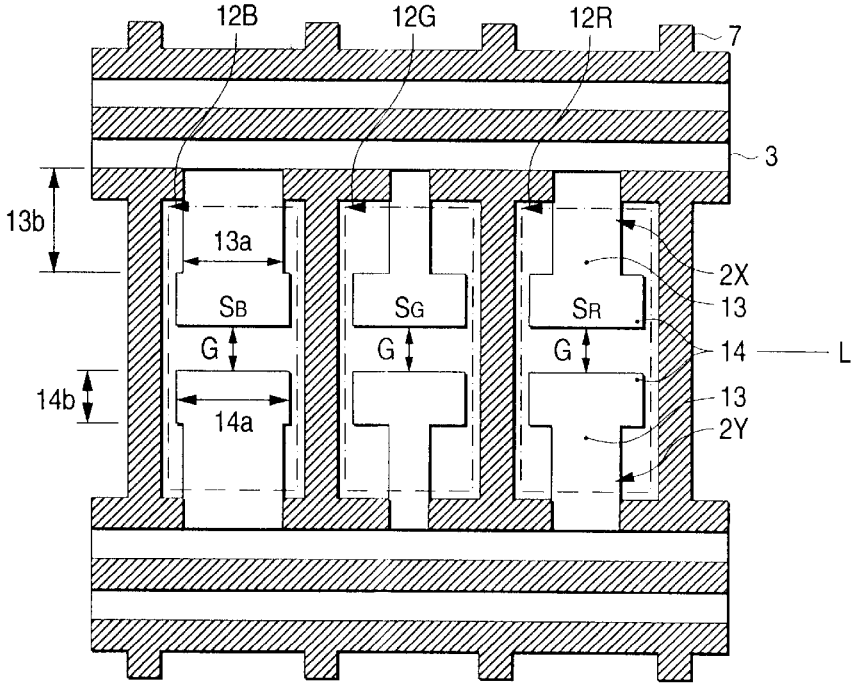

FIGS. 5A and 5B show a PDP 50 according to a third embodiment of the invention as a modified example of the structure comprised of the pairs of transparent electrodes 2X and 2Y and the barriers 7 in the first embodiment of the invention. More specifically, the barriers 7 are formed in parallel crosses in the PDP 50 according to the third embodiment of the invention so that the barriers 7, the bus electrodes 3 and regions between the bus electrodes 3 may also be overlapped.

Further, the area of each transparent electrode 2 is made variable by forming the width 14*a* and length 14*b* of the wide portion 14 uniformly and varying the width 13*a* of the narrow portion 13 while keeping the discharge gap G having a fixed width.

The PDP 50 shown in FIG. 5A is formed like what is shown in FIG. 3A in the first embodiment of the invention so as to make the area of the transparent electrode 2 within each discharge cell 12 satisfy Expression (1). Further, the PDP 50 shown in FIG. 5B is similarly formed so as to make the area of the transparent electrode 2 within each discharge cell 12 satisfy Expression (2). Therefore, the chromaticity of the emission of white light of the PDP 50 is adjusted as in the first embodiment of the invention.

Figure 6A:
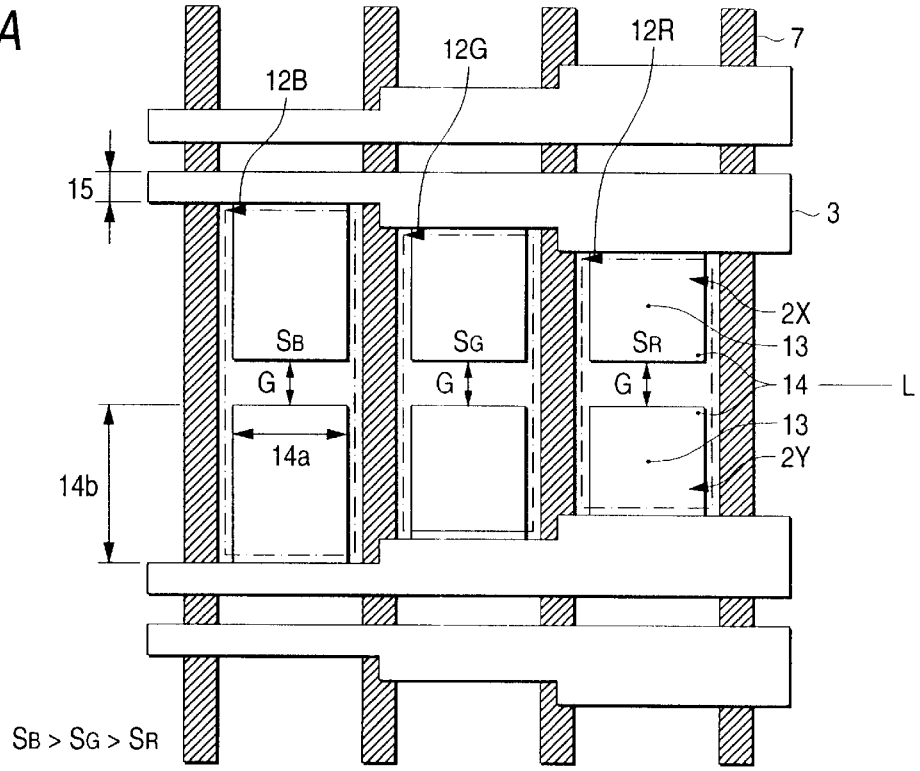
FIGS. 6A and 6B are structural diagrams of transparent electrodes of a PDP according to a fourth embodiment of the invention.
Figure 6B:
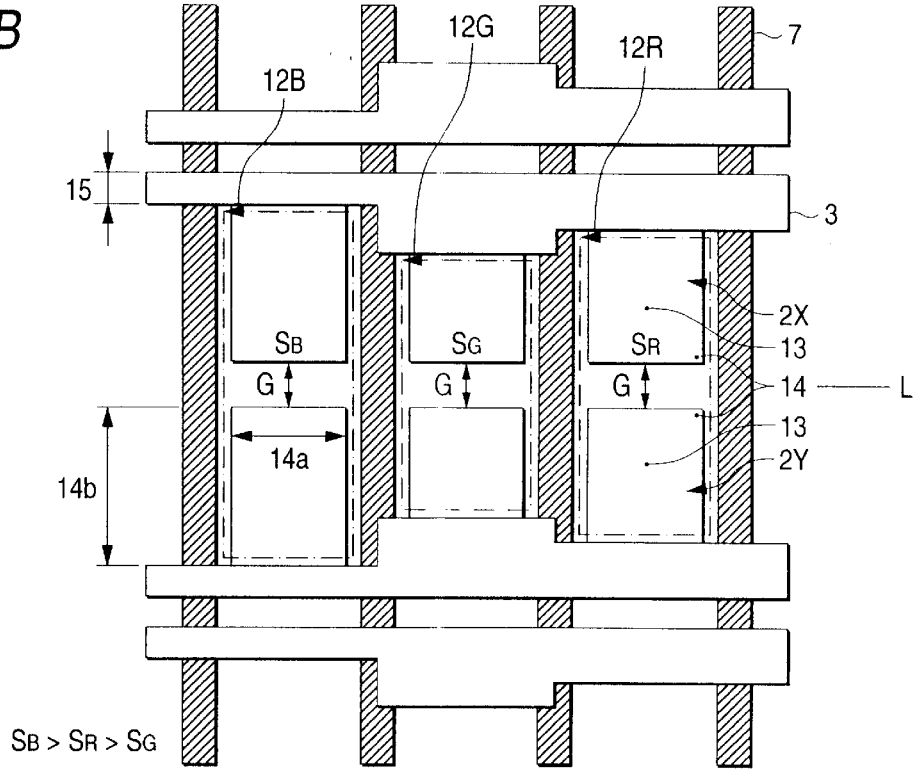
Figure 7:
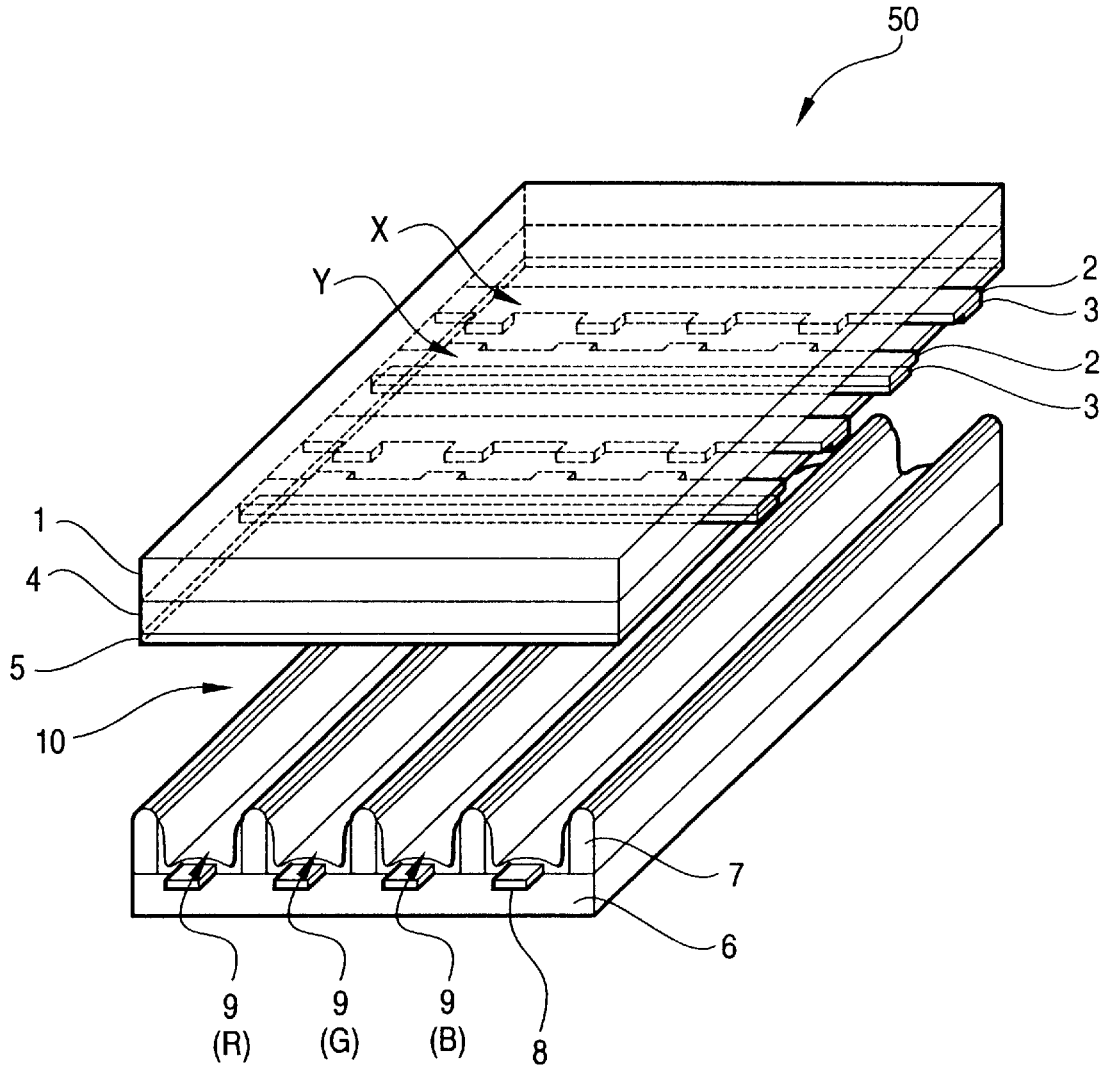
FIG. 7 is a perspective view of an exemplary arrangement of an AC type PDP.

FIGS. 6A and 6B show a PDP 50 according to a fourth embodiment of the invention as a modified example of the structure comprised of the pairs of transparent electrodes 2X and 2Y and the bus electrodes 3 in the first to third embodiments of the invention.

The bus electrodes 3 are formed of metallic films in order to reduce the impedance of the transparent electrodes 2. As the surface of the dielectric layer on the transparent electrodes is projected to the other portions, it is a portion that does not contribute the area of emission of light within the discharge cells 12. In comparison with the width 15 of the normal bus electrode shown in the first to third embodiments of the invention, the area of the transparent electrodes 2 used for light emissions will be reduced if the bus electrode 3 is formed so as to project in opposite directions, thus causing the surface of the dielectric layer thereon to project to the other portions.

Consequently, pairs of rectangular transparent electrodes 2X and 2Y are formed in the PDP 50 shown in FIG. 6A whereby to make the area of the transparent electrodes 2 within each discharge cell 12 satisfy Expression (1) by varying the width 15 of the pair of opposing bus electrodes 3 and the width of the projected portions of the dielectric layers on a discharge cell 12 basis. In the PDP 50 shown in FIG. 6B, moreover, the area of the transparent electrodes 2 within each discharge cell 12 is formed so as to satisfy Expression (2).

The adoption of such a structure that the surface of the dielectric layer 4 on the bus electrode 3 is projected (raised) relative to the other portions results in decreasing the parasitic capacity, increasing the discharge start voltage and restraining the discharge from spreading in the vertical direction of the adjoining discharge cells 12.

As described above, the areas of the row electrodes are made different in the discharge cells for different color of light emission in the PDP according to the present invention, whereby the chromaticity of emission of white light is properly adjusted and simultaneously the gradation level of each color is prevented from being lowered.

What is claimed is:

1. A plasma display panel comprising:

a pair of substrates disposed opposite to each other through a discharge space;

a plurality of pairs of row electrodes disposed on an inner surface of one of said pair of substrates;

a dielectric layer for covering said pairs of row electrodes from the discharge space;

a plurality of column electrodes extended in a direction of intersecting said pairs of row electrodes on an inner surface of the other of said pair of substrates in order to form a discharge cell in each intersecting portion; and fluorescent material layers for covering said column electrodes and giving off blue, green and red color light emissions, wherein an area of one of said pairs of row electrodes within at least one discharge cell for one color display out of the discharge cells for said color display is made different from an area of one of said pairs of row electrodes within another discharge cell for another color display, wherein an area of said one discharge cell for said one color display is the same as an area of said other discharge cell for said other color display, and wherein said one discharge cell for said one color display and said other discharge cell for said other color display constitute at least part of one pixel.

2. The plasma display panel as claimed in claim 1, wherein said pair of row electrodes forming said pairs of row electrodes include opposing transparent electrodes through a discharge gap therebetween, and metallic electrodes connected to said transparent electrodes in respective edge portions located opposite to the discharge gap, and wherein an area of said transparent electrodes within at least a discharge cell for one color display is made different from that of said transparent electrodes within discharge cells for other color display.

3. The plasma display panel as claimed in claim 2, wherein said transparent electrode is formed into an independent island shape in each of the discharge cells.

4. A display panel, comprising:

a first pair of row electrodes disposed in a first discharge cell corresponding to a first color;

a second pair of row electrodes disposed in a second discharge cell corresponding to a second color that is different than said first color;

a first column electrode that crosses said first pair of row electrodes in said first discharge cell;

a second column electrode that crosses said second pair of row electrodes in said second discharge cell;

wherein a first electrode area of said first pair of row electrodes within said first discharge cell is different that a second electrode area of said second pair of row electrodes in said second discharge cell, wherein a first cell area of said first discharge cell is the same as a second cell area of said second discharge cell, and wherein said first discharge cell and said second discharge cell constitute at least part of one pixel.

5. A display panel, comprising:

a first pair of row electrodes disposed in a first discharge cell corresponding to a first color;

a second pair of row electrodes disposed in a second discharge cell corresponding to a second color that is different than said first color;

a first column electrode that crosses said first pair of row electrodes in said first discharge cell;

a second column electrode that crosses said second pair of row electrodes in said second discharge cell;

wherein a first electrode area of said first pair of row electrodes within said first discharge cell is different that a second electrode area of said second pair of row electrodes in said second discharge cell, wherein a first cell area of said first discharge cell is the same as a second cell area of said second discharge cell, wherein said first pair of row electrodes comprises a first narrow portion in said first discharge cell and a first wide portion in said first discharge cell, wherein said first wide portion is coupled to said first narrow portion, wherein said second pair of row electrodes comprises a second narrow portion in said second discharge cell and a second wide portion in said second discharge cell, wherein said second wide portion is coupled to said second narrow portion, wherein a width of said first narrow portion in a first width direction, which is substantially perpendicular to a longitudinal axis of said first column electrode, is narrower than a width of said first wide portion in said first width direction, and wherein a width of said second narrow portion in a second width direction, which is substantially perpendicular to a longitudinal axis of said second column electrode, is narrower than a width of said second wide portion in said second width direction.

6. The display as claimed in claim 5, wherein a length of said first wide portion in a first length direction is longer than a length of said second wide portion in a second length direction, wherein said first length direction is substantially perpendicular to said first width direction and said second length direction is substantially perpendicular to said second width direction.

7. The display as claimed in claim 6, wherein a length of said first narrow portion in said first length direction is shorter than a length of said second narrow portion in said second length direction.

8. The display as claimed in claim 5, wherein said width of said first narrow portion in is longer than said width of said second narrow portion.

9. The display as claimed in claim 8, wherein a length of said first wide portion in a first length direction is substantially the same as a length of said second wide portion in a second length direction, wherein said first length direction is substantially perpendicular to said first width direction and said second length direction is substantially perpendicular to said second width direction.

10. The display as claimed in claim 4, wherein said first pair of row electrodes comprises a first electrode and a second electrode in said first discharge cell, wherein said first electrode and said second electrode are spaced apart from each other in said first discharge cell by a first gap distance, wherein said second pair of row electrodes comprises a third electrode and a fourth electrode in said second discharge cell, wherein said third electrode and said fourth electrode are spaced apart from each other in said first discharge cell by a second gap distance, and wherein said first gap distance and said second gap distance are approximately the same.

11. The display as claimed in claim 10, wherein said first gap distance is substantially parallel to a longitudinal axis of said first column electrode and said second gap distance is substantially parallel to a longitudinal axis of said second column electrode.

12. A display panel, comprising:

a first pair of row electrodes disposed in a first discharge cell corresponding to a first color;

a second pair of row electrodes disposed in a second discharge cell corresponding to a second color that is different than said first color;

a first column electrode that crosses said first pair of row electrodes in said first discharge cell;

a second column electrode that crosses said second pair of row electrodes in said second discharge cell;

wherein a first electrode area of said first pair of row electrodes within said first discharge cell is different that a second electrode area of said second pair of row electrodes in said second discharge cell, wherein a first cell area of said first discharge cell is the same as a second cell area of said second discharge cell, wherein said first pair of row electrodes comprises a first electrode and a second electrode in said first discharge cell, wherein said first electrode and said second electrode are spaced apart from each other in said first discharge cell by a first gap distance, wherein said second pair of row electrodes comprises a third electrode and a fourth electrode in said second discharge cell, wherein said third electrode and said fourth electrode are spaced apart from each other in said first discharge cell by a second gap distance, wherein said first gap distance and said second gap distance are approximately the same, wherein a first width of said first electrode is substantially the same as a second width of said third electrode, and wherein said first width is substantially perpendicular to said first gap distance and said second width is substantially perpendicular to said second gap distance.

13. A display panel, comprising:

a first pair of row electrodes disposed in a first discharge cell corresponding to a first color;

a second pair of row electrodes disposed in a second discharge cell corresponding to a second color that is different than said first color;

a first column electrode that crosses said first pair of row electrodes in said first discharge cell;

a second column electrode that crosses said second pair of row electrodes in said second discharge cell;

wherein a first electrode area of said first pair of row electrodes within said first discharge cell is different that a second electrode area of said second pair of row electrodes in said second discharge cell, wherein a first cell area of said first discharge cell is the same as a second cell area of said second discharge cell, wherein said first pair of row electrodes comprises a first electrode and a second electrode in said first discharge cell, wherein said first electrode and said second electrode are spaced apart from each other in said first discharge cell by a first gap distance, wherein said second pair of row electrodes comprises a third electrode and a fourth electrode in said second discharge cell, wherein said third electrode and said fourth electrode are spaced apart from each other in said first discharge cell by a second gap distance, wherein said first gap distance and said second gap distance are approximately the same, wherein said first gap distance is substantially parallel to a longitudinal axis of said first column electrode and said second gap distance is substantially parallel to a longitudinal axis of said second column electrode, wherein a first length of said first electrode is longer than a second length of said third electrode, and wherein said first length is substantially parallel to said first gap distance and said second length is substantially parallel to said second gap distance.

* * * * *